US011788800B2

(12) United States Patent
Grinham et al.

(10) Patent No.: US 11,788,800 B2
(45) Date of Patent: Oct. 17, 2023

(54) RADIANT COOLING DEVICES AND METHODS OF FORMING THE SAME

(71) Applicant: PRESIDENT AND FELLOWS OF HARVARD COLLEGE, Cambridge, MA (US)

(72) Inventors: Jonathan Grinham, Cambridge, MA (US); Martin Bechthold, Cambridge, MA (US); Salmaan Craig, Cambridge, MA (US); Donald Ingber, Boston, MA (US)

(73) Assignee: PRESIDENT AND FELLOWS OF HARVARD COLLEGE, Cambridge, MA (US)

( * ) Notice: Subject to any disclaimer, the term of this patent is extended or adjusted under 35 U.S.C. 154(b) by 0 days.

(21) Appl. No.: 16/629,899

(22) PCT Filed: Jul. 10, 2018

(86) PCT No.: PCT/US2018/041473
§ 371 (c)(1),
(2) Date: Jan. 9, 2020

(87) PCT Pub. No.: WO2019/014240
PCT Pub. Date: Jan. 17, 2019

(65) Prior Publication Data

US 2020/0271395 A1 Aug. 27, 2020

Related U.S. Application Data

(60) Provisional application No. 62/530,394, filed on Jul. 10, 2017.

(51) Int. Cl.

| | |
|---|---|
| ***F28F 3/12*** | (2006.01) |
| ***F28D 9/00*** | (2006.01) |
| ***F28F 21/06*** | (2006.01) |

(52) U.S. Cl.
CPC ..... *F28F 3/12* (2013.01); *F28D 9/0025* (2013.01); *F28D 9/0087* (2013.01);
(Continued)

(58) Field of Classification Search
CPC ..... F28F 3/12; F28D 2001/02863; F28D 1/0308; F28D 1/0358
See application file for complete search history.

(56) References Cited

U.S. PATENT DOCUMENTS 2,515,972 A * 7/1950 White et al. ..... F25B 39/02 29/890.035
3,498,372 A * 3/1970 Patten et al. ..... F28D 9/0062 261/112.1

(Continued)

FOREIGN PATENT DOCUMENTS

DE 10 2008 020 230 A1 10/2008

OTHER PUBLICATIONS

International Search Report and Written Opinion in International Patent Application No. PCT/US2018/041473, dated Sep. 13, 2018 (2 pages).

(Continued)

*Primary Examiner* — Jianying C Atkisson
*Assistant Examiner* — For K Ling
(74) *Attorney, Agent, or Firm* — NIXON PEABODY LLP

(57) ABSTRACT

A radiant cooling device comprises at least one fluidic layer including one or more micro-channel liquid-circuits and at least one structural layer coupled to the at least one fluidic layer. The device further includes a plurality of folds such that the device has a three-dimensional surface geometry having a plurality of inclined surfaces.

21 Claims, 6 Drawing Sheets

(52) U.S. Cl.
CPC ..... *F28F 21/065* (2013.01); *F28F 2210/02* (2013.01); *F28F 2260/02* (2013.01)

(56) References Cited

U.S. PATENT DOCUMENTS

| | | | | |
|---|---|---|---|---|
| 3,502,141 | A * | 3/1970 | Allen | F28F 13/06 165/170 |
| 3,847,211 | A | 11/1974 | Fischel | |
| 4,246,962 | A * | 1/1981 | Norback | F24F 3/147 165/166 |
| 4,279,244 | A | 7/1981 | McAlister | |
| 4,874,646 | A | 10/1989 | Tsujino | |
| 5,467,817 | A * | 11/1995 | Schwald | B01D 9/0013 165/170 |
| 8,662,150 | B2 * | 3/2014 | Kippel | F28F 25/087 165/166 |
| 2003/0098142 | A1 * | 5/2003 | Seki et al. | F24D 3/16 165/49 |
| 2005/0019934 | A1 | 1/2005 | Duerr | |
| 2006/0124287 | A1 | 6/2006 | Reinders | |
| 2007/0077771 | A1 | 4/2007 | Plissonnier | |
| 2014/0123578 | A1 | 5/2014 | Ingber | |

OTHER PUBLICATIONS

Bartholomeusz, R. et al.; "Xurography: Rapid Prototyping of Microstructures Using a Cutting Plotter"; Journal of Microelectromechanical Systems, vol. 14, No. 6; Dec. 2005; pp. 1364-1374 (11 pages).
Bejan, A.; "Simple methods for convection in porous media: scale analysis and the intersection of asymptotes"; International Journal of Energy Research, 2003; 27:859-874 (DOI: 10.1002/er.922) (16 pages).
Blees, M. et al.; "Graphene kirigami"; Nature, vol. 524; Aug. 13, 2015; pp. 204-213 (9 pages).
Cheung, K. et al.; "Origami interleaved tube cellular materials"; Smart Materials and Structures, 23 (2014) doi:10.1088/0964-1726/23/9/094012; pp. 1-10 (11 pages).
Cooksey, G. et al.; "Pneumatic valves in folded 2D and 3D fluidic devices made from plastic films and tapes"; Technical Innovation, vol. 14; May 21, 2014; pp. 1665-1668 (5 pages).
Demaine, E. et al.; "Curved Crease Folding a Review on Art, Design and Mathematics"; Computer Science and Artificial Intelligence Laboratory, Massachusetts Institute of Technology; 2011 (8 pages).
Diaz, M. et al.; "Geometric Mechanics of Curved Crease Origami"; Physical Review Letters, 109, 114301; Sep. 14, 2012 (13 pages).
Dudte, L. et al.; "Programming curvature using origami tessellations"; Nature Materials, DOI: 10.1038/NMAT4540; Jan. 25, 2016 (7 pages).
Eidini, M. et al.; "Unraveling metamaterial properties in zigzag-base folded sheets"; Eidini and Paulino, Sci. Adv. 2015;1e1500224; Sep. 18, 2015 (7 pages).
Eidini, M. et al.; "Zigzag-base folded sheet cellular mechanical metamateriais"; Extreme Mechanics Letters 6 (2016) pp. 96-102 (7 pages).
Feng, J. et al.; "Cooling load differences between radiant and air systems"; UC Berkeley, HVAC Systems; Oct. 1, 2013 (21 pages).
Feng, J. et al.; "Experimental comparison of zone cooling load between radiant and air systems" UC Berkeley, HVAC Systems; Dec. 1, 2014 (16 pages).
Filipov, E. at al.; "Origami tubes assembled into stiff, yet reconfigurable structures and metamaterials"; PNAS, vol. 112, No. 40; Oct. 6, 2015; pp. 12321-12326 (6 pages).
Huh, D. et al.; "From 3D cell culture to organs-on-chips" Trends in Cell Biology, vol. 21, No. 12, pp. 745-754; Dec. 2011 (10 pages).
Mahadevan, L. et al.; "BREVIA—Self-Organized Origami"; www.sciencemag.org; vol. 307; Mar. 18, 2005 (2 pages).
Novoselac, A. et al.; "A critical review on the performance and design of combined cooled ceiling and displacement ventilation systems"; Energy and Buildings 34 (2002), pp. 496-509 (13 pages).
Novoselac, A. et al.; "New Convection Correlations for Cooled Ceiling Panels in Room with Mixed and Stratified Airflow"; HVAC&R Research, vol. 12, No, 2, pp. 279-294; Apr. 2006 (17 pages).
Overvelde, J. et al.; "A three-dimensional actuated origami-inspired transformable metamaterial with multiple degrees of freedom"; Nature Communications, DOI: 10.1038/ncomms10929; Mar. 11, 2016 (8 pages).
Ramos-Alvarado, B. et al.; "Numerical investigation of the performance of symmetric flow distributors as flow channels for PEM fuel cells"; International Journal of Hydrogen Energy 37 (2012); pp; 436-448 (13 pages).
Shelden, D.; "Digital Surface Representation and the Constructibility of Gehry's Architecture"; Department of Architecture; Aug. 9, 2002 (340 pages).
Sreetharan, P.S. et al.; "Monolithic fabrication of millimeter-scale machines" Journal of Micromechanics and Microengineering, doi:10.1088/0960-1317/22/5/055027; Feb. 13, 2012; pp. 1-6 (7 pages).
Stetiu, C.; "Radiant cooling in U.S. Office buildings; Towards eliminating the perception of climate-imposed barriers" Lawrence Berkeley National Laboratory; (1998) (246 pages).
Tachi, T. et al.; "Designing One-DOF Mechanisms for Architecture by Rationalizing Curved Folding"; Proceedings of the International Symposium on Algorithmic Design for Architecture and Urban Design; Mar. 14-16, 2011 (14 pages).
Wang, J.; "Theory of flow distribution in manifolds"; Chemical Engineering Journal 168; Feb. 20, 2011; pp. 1331-1345 (17 pages).
Wei, Z.Y. et al.; "Geometric Mechanics of Periodic Pleated Origami"; American Physical Society, PRL 110, 215501; May 24, 2013; May 24, 2013 (21 pages).
Weigl, B. et al.; "Design and Rapid Prototyping of Thin-Film Laminate-Based Microfluidic Devices"; Biomedical Microdevices, pp. 267-274 (2001) (8 pages).
Yuen, P.K. et al.; "Low-cost rapid prototyping of flexible microfluidic devices using a desktop digital craft cutter"; The Royal Society of Chemistry, Lab Chip, (2010), pp. 384-387 (4 pages).
Zhang. Y. et al.; "A mechanically driven form of Kirigami as a route to 3D mesostructures in micro/nanomembranes"; www.pnas.org/cgi/doi/10.1073/pnas.1515602112; Aug. 7, 2015 (8 pages).
Jeong, J.W. et al.; "Ceiling radiant cooling panel capacity enhanced by mized convection in mechanically ventialted spaces"; Applied Thermal Engineering; Jun. 10, 2003 (14 pages).
Tuckerman, D.B. et al.; High-Performance Heat Sinking for VLSI, IEEE Electron Device Letters, vol. EDL-2, No. 5; May 1981, pp, 126-129 (5 pages).
Ramos-Alvarado, B. et al.; "CDD study of liquid-cooled heat sinks with microchannel flow field configurations for electronics, fuel cells, and concentrated solar cells"; Applied Thermal Engineering 31 (2011), pp, 2494-2507 (14 pages).
Shukuya, M.. et al.; "Introduction to the Concept of Exergy—for a Better Understanding of Low-Temperature-Heating and High-Temperature-Cooling Systems"; Espoo; VTT Tiedottieita; Apr. 25, 2002 (61 pages).
Lienhard, J.H. et al.; "A Heat Transfer Textbook"; Phlogiston Press, Version 2.11; Jul. 17, 2017 (768 pages).

* cited by examiner

θ.°=15°

θ.°=45°

θ.°=60°

RADIANT COOLING DEVICES AND METHODS OF FORMING THE SAME

CROSS-REFERENCE TO RELATED APPLICATIONS

This application is a U.S. National Stage Application of International Application No. PCT/US2018/041471, filed Jul. 10, 2018, which claims priority to U.S. Provisional Patent Application No. 62/530,394, filed Jul. 10, 2017, both of which are hereby incorporated by reference herein in their entireties.

TECHNICAL FIELD

The present invention relates to radiant cooling devices. More specifically, the invention relates to a laminate radiant cooling device including fluidic and structural layers having three-dimensional (3D) surface geometries and methods of making and using the same.

BACKGROUND

Heating, ventilation, and air-conditioning (HVAC) relates to the creation of a thermally comfortable indoor air environment. Typically, HVAC in buildings follows one of two models: (1) an all-air system or (2) a hybrid system. Generally, all-air systems are designed around a central air-handling unit that delivers enough heated or cooled air to satisfy building loads.

Hybrid systems combine hydronic (water-side) systems with air-side ventilation systems. Air-side systems are typically designed to satisfy ventilation requirement. Hydronic systems are designed to balance sensible cooling and heating loads. These systems typically deliver heating and cooling through water-based products, such as concrete-core thermally active surfaces (TABs), radiant ceiling panels (RCPs), a combination thereof, or the like. Radiant panels add energy to—or remove energy from—a room through radiant heat exchange with surfaces in the room, directly with occupants, or a combination thereof. To a generally lesser extent, radiant panels add or remove energy through convection heat exchange with the air.

Hybrid systems provide well-established primary energy efficiency, as compared to traditional all-air systems. All-air systems are generally required to treat the entire volume of air within a given space. Hydronic systems, on the other hand, cool only the surfaces, equipment, and occupants in a space. As such, water supplied to such surfaces can be at a substantially lower temperature-lift. In some instances, the water may be provided at a temperature of about 4° C. to about 8° C. (compared to about 20° C. for all-air systems), which provides opportunities for energy reduction through heat pump loads and cooling hours. Furthermore, water's heat transfer capacity generally reduces the amount of energy required to transport a generally equivalent amount of heat in an all-air system, resulting in reduced fan energy.

Water-side thermal control systems typically deliver radiant heating and cooling using many building products and infrastructure systems. For example, RCPs are generally decoupled from large-scale convective air flows. Chilled sails (CSs), on the other hand, include freestanding profiles (or fins) intended to provide convective heat exchange. With CSs, the separation of cooling fins offers a higher cooling capacity by allowing forced or density-driven air flows to be cooled by the fins and drop through openings into the space below. The increased convection flows have been shown to shift the balance of radiant and convection cooling from a near-even (about 50/50%) split in RCPs to an about 30/70% split in CSs for radiant and convection cooling, respectively. While cooling effects of increased heat transfer through convection air flow have been studied, the effects of surface geometry on heat transfer rates and total cooling rates are largely unknown. Likewise, while the benefits of water-based thermal control are generally known, the industry and architectural adoption has remained fairly stagnant.

It would be desirable to have radiant cooling devices that offer added energy efficiency and enable new approaches to water-based thermal control.

SUMMARY

According to one aspect, a radiant cooling device comprises at least one fluidic layer including one or more micro-channel liquid-circuits and at least one structural layer coupled to the at least one fluidic layer. The device further includes a plurality of folds such that the device has a three-dimensional surface geometry having a plurality of inclined surfaces.

According to one process, a method of forming a radiant cooling device includes providing at least one fluidic layer including one or more micro-channel liquid-circuits and coupling at least one structural layer to the at least one fluidic layer to form a laminated structure. The method further includes folding or bending the laminated structure to form a plurality of folds thereon. The plurality of folds forms a three-dimensional surface geometry having a plurality of inclined surfaces.

Figure 1:
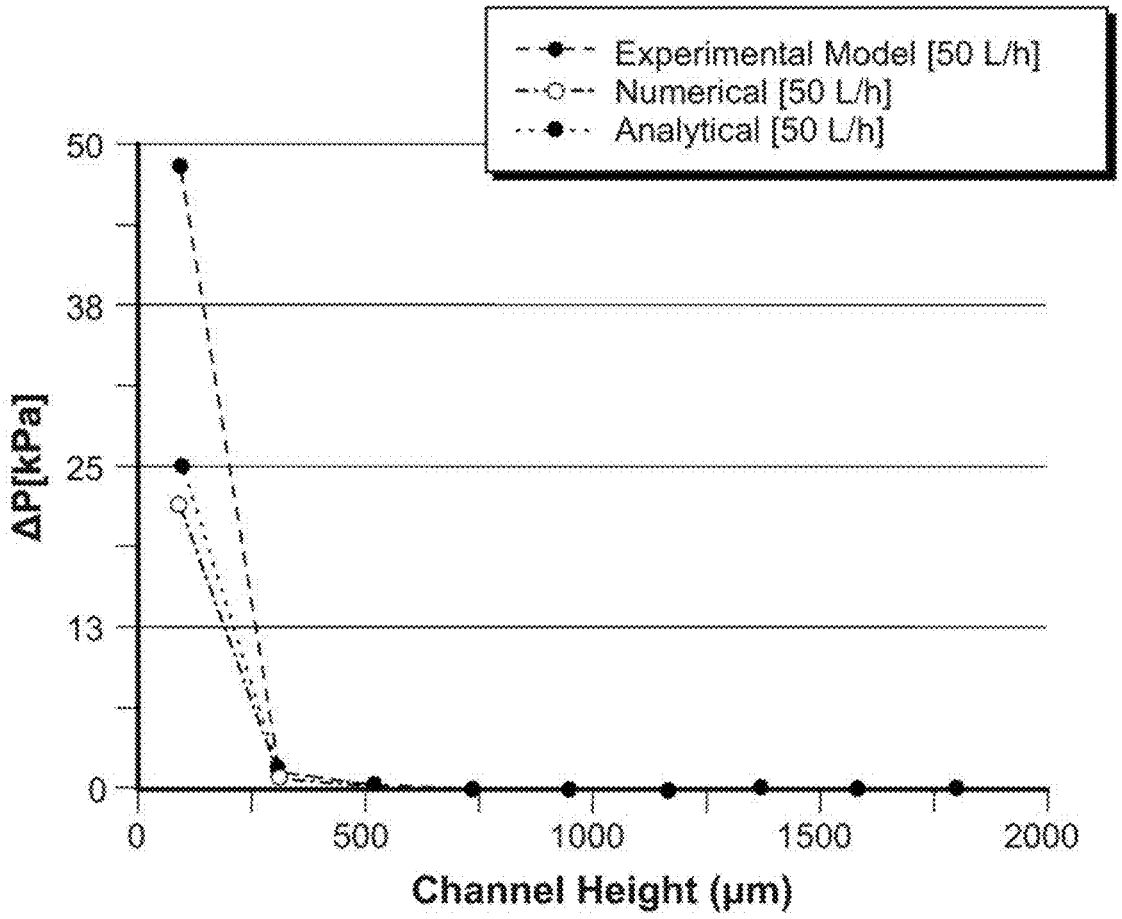
FIG. 1 shows a numerical, analytical, and experimental comparison of prototypical devices with channel heights ranging from about 100 μm to about 1000 μm.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is illustrative of the principles of the invention and is not intended to limit the broad aspect of the invention to the embodiments illustrated.

According to the aspects described herein, a radiant cooling device (e.g., radiant ceiling panel (RCP)) uses laminate fabrication and microfluidic liquid-circuits (e.g., water-circuits) to enable three-dimensional (3D) surface geometries that increase cooling efficiency. "Micro-," as used herein, generally refers to dimensions ranging from about 1000 nm to about 1000 μm.

The laminated assemblies or radiant ceiling devices described herein will be referred to as vascularized-laminate chilled sails (VLCS). One goal of the embodiments described herein is to increase the device's total cooling rate by increasing the surface area available for heat transfer within a finite space and, in turn, reducing the water temperature-lift required for a given cooling load. The proposed efficiency is achievable due to the fabrication and design methods, described in more detail below, that enable the use of laminate micro-channel water-circuits that may be assembled flat and then folded or bent, resulting in origami-inspired, 3D surface geometries with higher surface area densities, increased convective heat transfer rates, and increased thermal conductance.

According to one embodiment, a multi-layered radiant cooling device is described. The device is a thin film laminate micro-to-milli-channel system including at least one inner fluidic micro-channel water-circuit layer and at least one outer solid structural layer. Each layer is composed of a sheet material having a generally two-dimensional (2D) surface geometry. The layers are coupled (e.g., laminated or adhered) to one another. The layers may be bonded to one another using, e.g., heat-sensitive or pressure-sensitive adhesive laminates, a weak solvent bonding agent, chemical bonding, another other suitable bonding agent, or any combination thereof.

Devices are generally deployed at a projection area of about 1 $m^2$ to about 2 $m^2$. Multiple devices may be arrayed in parallel or in series (using connecting tubing such as, for example, polymer or copper tubing) to accommodate a space's heating and cooling load (total area on an order of >10 $m^2$). The heating or cooling load generally varies based on building use type (e.g., construction, equipment, etc.), building location climate, building occupancy, combinations thereof, and the like. In some non-limiting embodiments, a single device has a width ranging from about 125 mm to about 1500 mm and length ranging from about 600 mm to about 5000 mm. The laminate assemblies described herein can be composed of as few as about 3 layers or upwards of about 9 or more layers. The total layer heights may range from about 50 μm to about 2000 μm for the flexible fluid layer(s) and about 250 μm to about 4000 μm for the structural layer(s) for metal (or polymers) and glass, respectively. In some embodiments, the total device height can range from about 1000 μm to about 10000 μm.

The microfluidic water-circuit designs of the fluidic layer(s) are generally translated from flow systems for micro-channel devices, microscale engineering technologies, fluid computation, bioengineering, chemistry, heat transfer, combinations thereof, or the like. In some embodiments, the fluidic layer is flexible. In lieu of larger-diameter (e.g., typically greater than about 13 mm) piping that is typically mechanically fastened to fin geometries, the use of micro-channel water-circuits as inner layers promotes the distribution of microfluidic channels across all or substantially all of a given surface area using distributor and/or collector channels or networks. The fluidic inner micro-channel water circuits may be designed using any number of networked channel geometries such as parallel, serpentine, diamond, branching, other arbitrary shapes, any combination thereof, or the like.

Multiple micro-channel liquid-circuits can be arrayed across multiple surfaces or devices in series or in parallel using the distributor and/or collector channels or networks. Channel dimensions may be varied for optimization. For example, the channel widths and/or heights may be varied to reduce pressure head losses. Referring to FIG. 1, a numerical, analytical, and experimental comparison of prototypical devices with channel heights ranging from about 100 μm to about 1000 μm is shown. As shown, hydraulic resistance decreases by a power of about 3 with increased channel height. Moreover, with channels arrayed in parallel, total pressure loss can be comparable to larger-diameter devices.

In some embodiments, the micro-channel height is scaled based on laminate thickness. In some embodiments, multiple flexible micro-channel water-circuit layers may be stacked together, and the micro-channels of the respective flexible layers may be fluidly coupled to one another using through holes, or "vias," to produce multi-layer water circuits.

The combination of generally flexible fluidic micro-channel water-circuit layers and generally rigid structural layers allows for the creation of mechanical joints, which enable the laminated structure to be assembled flat then folded or bent to form a plurality of folds thereon. As a result of the folding or bending, 3D surface geometries inspired by origami, developable surface geometries, curved creased folding, prismatic structures, meta-materials, combinations thereof, and the like may be formed. The laminated structure may be folded in a generally linear fashion (see FIG. 2B), in a generally zigzag fashion (see FIGS. 2A, 2C), in a curved fashion (see FIG. 2D), any combination thereof, or the like to create the desired 3D surface geometries.

FIGS. 2A-2D show detailed views of non-limiting examples of VLCSs having 31) surface geometries including a plurality of inclined surfaces 8 formed by folding and/or bending the laminated VLCS structure. The inclined surfaces may have any suitable angle ranging from about 0 to about 75°. In some embodiments, the angle of at least some of the inclined surfaces ranges from about 5° to about 45°.

Figure 3:
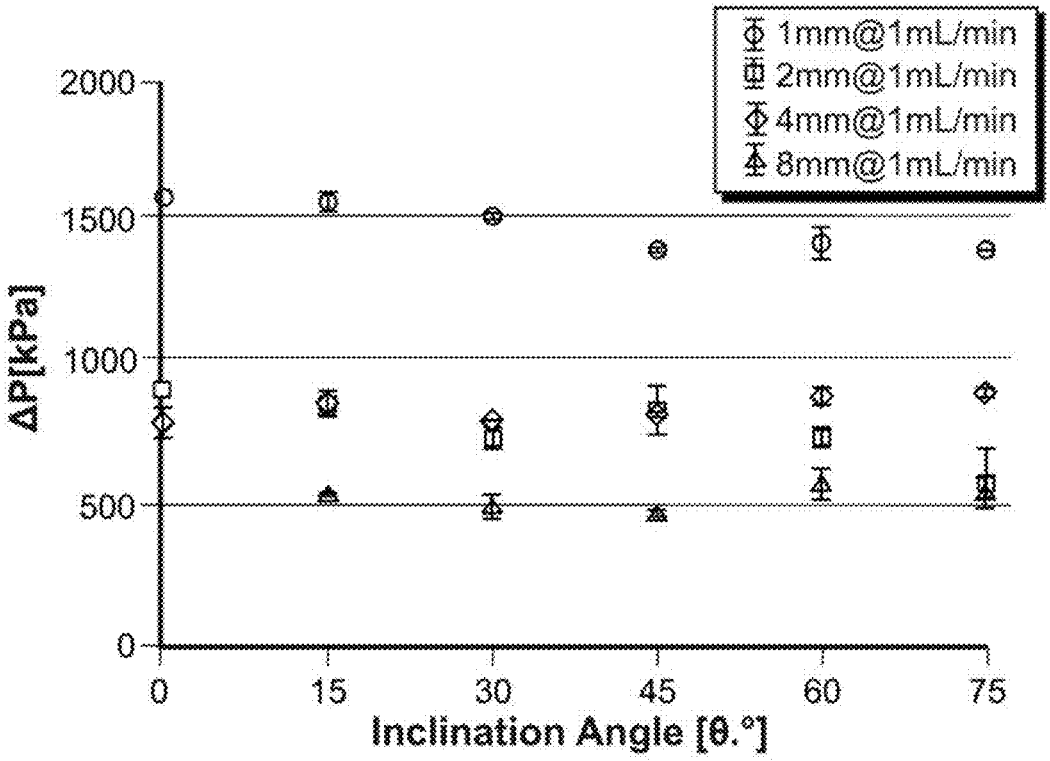
FIG. 3 shows experimental results for pressure drop across multiple single channel samples with widths ranging from about 1 mm to about 8 mm when folded at multiple inclination angles ranging from about 0° to about 75°.

Referring to FIG. 3, experimental results for pressure drop across multiple single channel samples with widths ranging from 1 mm to about 8 mm when folded at multiple inclination angles ranging from about 0° to about 75° is shown according to one non-limiting embodiment. The data shows that for the prototypical design (widths ranging from about 1000 μm to about 8000 μm, height of about 250 μm, bending radius of about 4 mm) there is no noticeable added pressure loss as inclination angle increases.

The inclined surfaces of the devices described herein may form any suitable pattern including, but not limited to, accordion pleating, a plurality of alternating inclined surfaces, other geometries, or any combination thereof. It is contemplated that 3D surface geometries may include any suitable non-flat surfaces including, but not limited to, inclined surfaces and/or surfaces having peaks, points, ridges, valleys, cavities, combinations thereof, or the like. In some embodiments, the 3D surface geometry includes a pattern that may be generally uniform and/or repeating. In other embodiments, the 3D surface geometry is non-uniform, random, and/or arbitrary.

Figure 2A:
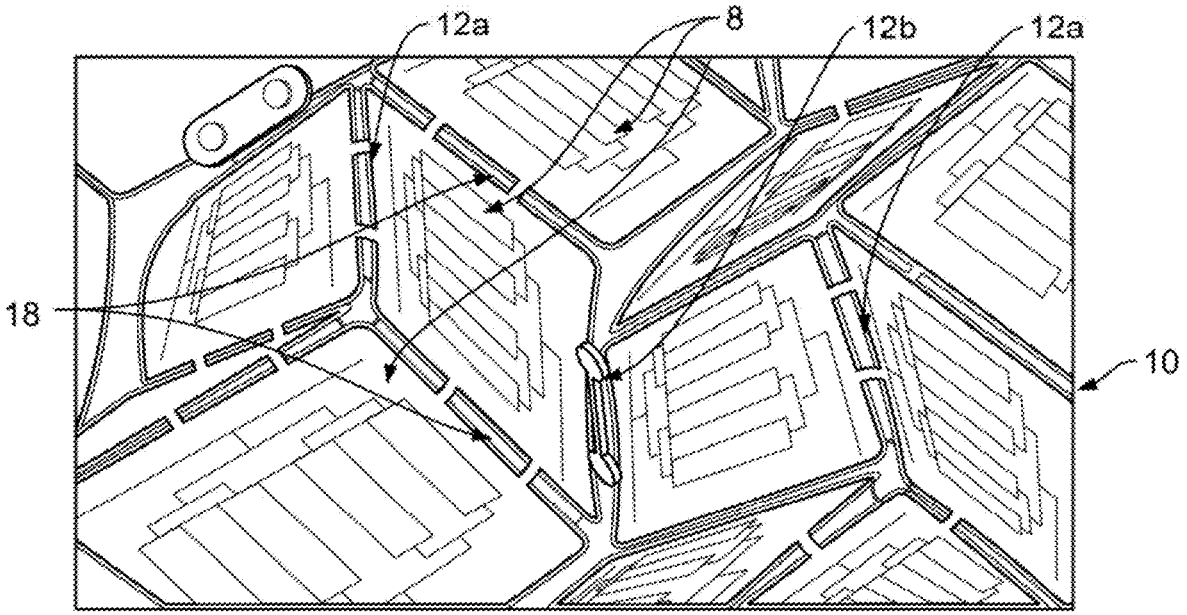
FIG. 2A shows a detailed view of an exemplary zigzag-folded polyethylene terephthalate (PET) vascularized-laminate chilled sail (VLCS).
Figure 2B:
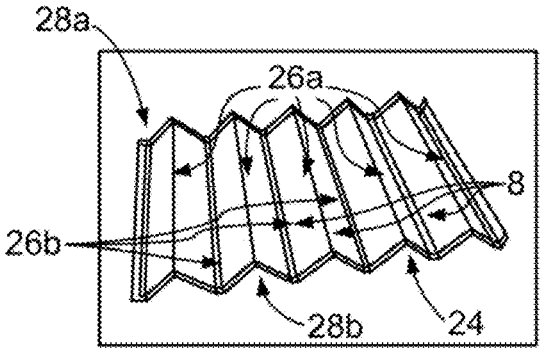
FIG. 2B shows a detailed view of an exemplary folded PET VLCS.
Figure 2C:
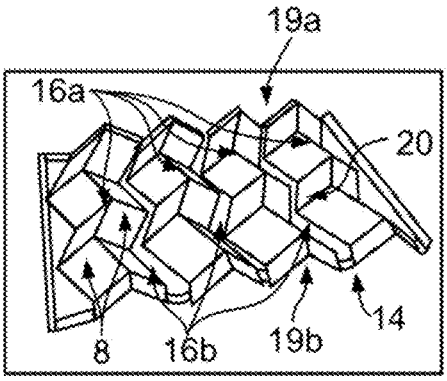
FIG. 2C shows a detailed view of an exemplary zigzag-folded aluminum VLCS.

Specifically, FIG. 2A shows a VLCS 10 fabricated from clear polyethylene terephthalate (PET) having a plurality of zigzag folds 12, and FIG. 2C shows a VLCS 14 fabricated from aluminum having a plurality of zigzag folds 16. The plurality of zigzag folds 12, 16 of the VLCSs 10, 14 of FIGS. 2A and 1C generally extend from a first end 19*a* of the VLCS to an opposing second end 19*b* of the VLCS (see FIG. 2C). The plurality of zigzag folds 12, 16 includes a first set of folds 12*a*, 16*a* arranged in an alternating manner with each of a second set of folds 12*b*, 16*b*. Each of the folds in the first set of folds 12*a*, 16*a* is generally coplanar in a first plane, and each of the folds in the second set of folds 12*b*, 16*b* is generally coplanar in a second plane such that the plurality of inclined surfaces 8 is formed. In addition, as shown in FIGS. 2A and 2C, a zigzag shape is formed, e.g., when viewed from a side of the VLCS tangential to the folds. In the illustrated embodiments of FIGS. 2A and 2C, the VLCSs 10, 14 also include a respective plurality of inclined surfaces 8 and zigzag folds 18, 20 being positioned generally perpendicular to the first set of zigzag folds 12, 16. The zigzag shape may include a plurality of bent and/or curved surfaces.

FIG. 2B shows a VLCS 24 fabricated from PET having a plurality of generally linear folds 26. The plurality of folds 26 extend from a first end of the VLCS 28*a* to an opposing second end 28*b* of the VLCS 24 to form a plurality of inclined surfaces 8. The plurality of folds 26 includes a first set of folds 26*a* arranged in an alternating manner with each of a second set of folds 26*b*. Each fold in the first set of folds 26*a* is generally coplanar in a first plane, and each fold in the second set of folds 26*b* is generally coplanar in a second plane such that a zigzag shape is formed, e.g., when viewed from a direction generally coaxial with the folds 26.

Figure 2D:
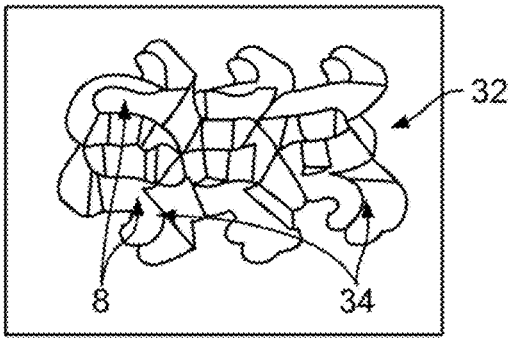
FIG. 2D shows a detailed view of an exemplary curved-folded PET VLCS.

FIG. 2D shows a VLCS 32 fabricated from PET having a plurality of curved folds 34. Like those of FIGS. 2A-2C, the plurality of curved folds 34 forms a 3D surface geometry having a plurality if inclined surfaces 8 on the VLCS 32.

VLCSs having folded or similar 3D surface geometries have several benefits including, but not limited to, increased cooling power density through increased surface area per volume fraction, increased convective heat exchange rate acting on an inclined surface, more readily tunable thermal, structural, and optical properties, and the like.

The ability to fabricate 2D laminated structures into devices having 3D surface geometries, as described herein, provides avenues for introducing a number of material properties ad hoc. The device can be designed using a range of materials to tune structural behavior, transparency, color, light reflection, acoustic behavior, combinations thereof, or the like. For example, the surface properties of the device may be adjusted by selecting the structural laminate material properties. The embodiments disclosed herein may utilize a broad range of transparent materials. For example, the fluidic micro-channel liquid-circuit layer may be formed of glass, one or more polymers (e.g., silicone, polyvinyl chloride, polycarbonate, polyurethane, polystyrene, polyethylene terephthalate, epoxy, poly(methyl methacrylate), styrene acrylonitrile, polysulphonate, polymethylpentene, polypropylene, styrene-ethylene-butylene-styrene, combinations thereof, or the like), or the like. The structural layer may be formed of glass, biomaterial, thermoplastic, ceramic, technical ceramic(s), non-technical ceramic(s), metal alloys (e.g., aluminum, stainless steel, mild steel, copper, combinations thereof, or the like), combinations thereof, or the like.

The devices described herein may be deployed as a suspended surface, a free standing structure, or any combination thereof. The devices may be suspended using a structural (e.g., metal, wood, plastic) framing system or may be suspended within existent structural ceiling grids. When used as a partition, the devices may be free standing or integrated with a structural (e.g., metal, wood, plastic) framing system. The devices may be connected to a primary piping system using polymer tubing (e.g., PEX (crossed-linked polyethylene)), copper tubing, tubing formed from another metal, metal alloy, other suitable material, or any combination thereof. Multiple devices may be connected together using similar piping systems.

Figure 4A:
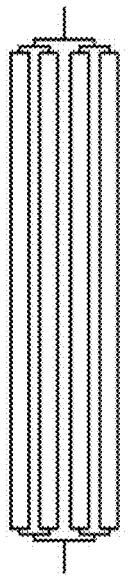
FIG. 4A is a schematic drawing of a microfluidic water-circuit for a flat VLCS geometry, according to one embodiment.
Figure 4B:
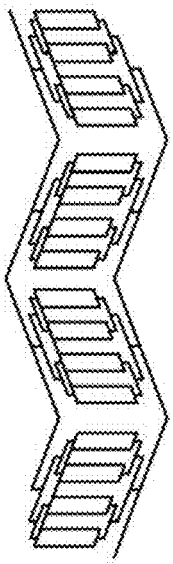
FIG. 4B is a schematic drawing of a microfluidic water-circuit for a zigzag VLCS geometry, according to one embodiment.
Figure 4C:
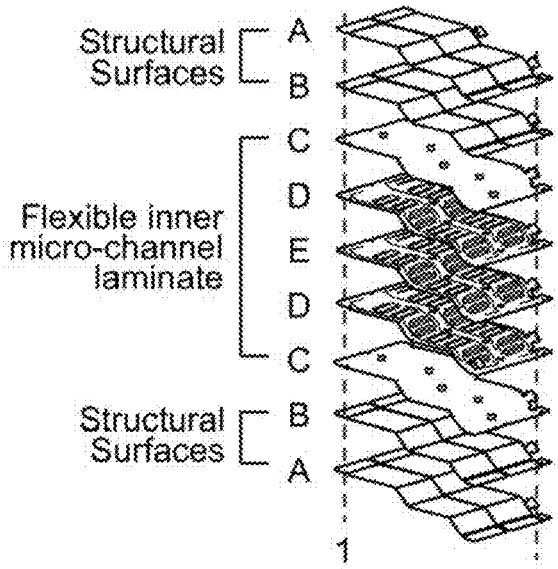
FIG. 4C is a schematic drawing of a laminate panel assembly according to one embodiment.

FIG. 4A is a schematic drawing of a microfluidic water-circuit for a flat surface geometry, and FIG. 4B is a schematic drawing of a microfluidic water-circuit for a zigzag surface geometry, according to exemplary embodiments. FIG. 4C is a schematic drawing of a laminate panel assembly according to one embodiment. The panel assembly of FIG. 4C includes the following layers: (A) about 250 μm PET; (B) double-sided adhesive with about 50 μm PET substrate; (C) about 75 μm PET; (D) double-sided adhesive with about 50 μm PET substrate; (E) about 150 μm PET; and (1) alignment pins. It is contemplated that the layers may be formed of other suitable materials such as, but not limited to, heat activated mounting films with a PET or other substrate, foamed acrylic adhesive(s), solvent bonding agent(s) (e.g., plastic cement), covalent bonding, any combination thereof, or the like. It is further contemplated that the layers may have other thicknesses, e.g., from about 50 μm to about 1000 μm. It is also contemplated that more or less of each of the layers may be included in the assembly.

Figure 5A:
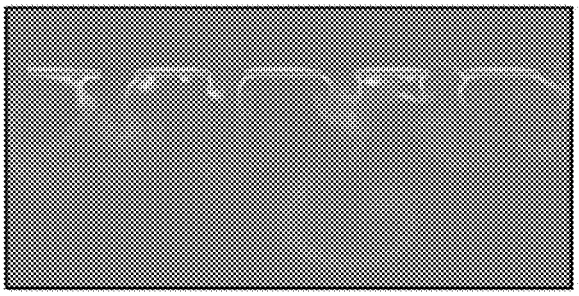
FIG. 5A illustrates a two-dimensional (2D) transient numerical model of boundary layer behavior for an isothermal flat chilled sail (CS) surface according to one embodiment at a $\Delta T$ of about 10° C. in the laminar regime, for air at a temperature of about 20° C.
Figure 5B:
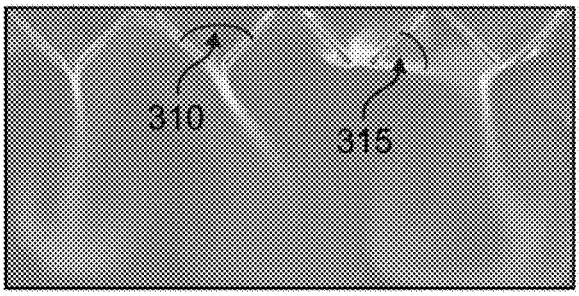
FIG. 5B illustrates a 2D transient numerical model of boundary layer behavior for an isothermal surface of a VLCS folded at an about 45° inclination angle according to one embodiment at a ΔT of about 10° C. in the laminar regime, for air at a temperature of about 20° C.

FIGS. 5A-5B illustrate non-limiting examples of 2D transient numerical models of boundary layer behavior for isothermal surfaces at a ΔT of about 10° C. in the laminar regime, for air at about 20° C. FIG. 5A shows a flat chilled sail, and FIG. 5B shows a VLCS folded at an about 90° interior angle 310 (between two surfaces) and having an inclination angle 315 (of a single surface) of about 45°. The models were computed using COMSOL MULTIPHYSICS) (Comsol AB Corporation Sweden, Stockholm, Sweden) software. The models generally provide a qualitative comparison of convection boundary layer behavior on flat surfaces (FIG. 5A) and VLCS' inclined surfaces (FIG. 5B). FIG. 5B shows the effects of gravity acting on the buoyancy-driven boundary layer, which increases the velocity of air flow at the top and bottom surfaces of the device, thereby increasing the rate of convection heat exchange (relative to the flat surface).

As the surface of the VLCS is inclined from generally horizontal to generally vertical, the cooled boundary layers on the top surface move from a near-quiescent state when flat to a flowing plume as the surface inclines and the effect of gravity overcomes the viscous shear forces of the moving air against the surface. On the bottom surface, gravity already affects the cooled boundary layer. In the flat state, the cooled boundary layers fall as packets of thermals, but as the surface inclination increases, a real "snowball effect" occurs. The cooled packets are generally entrained in the boundary layer flow and drip off the surface as a larger single plume. In turn, the rate of convective heat exchange generally increases for both the top and bottom of the surface as the inclination angle increases.

Figure 6A:
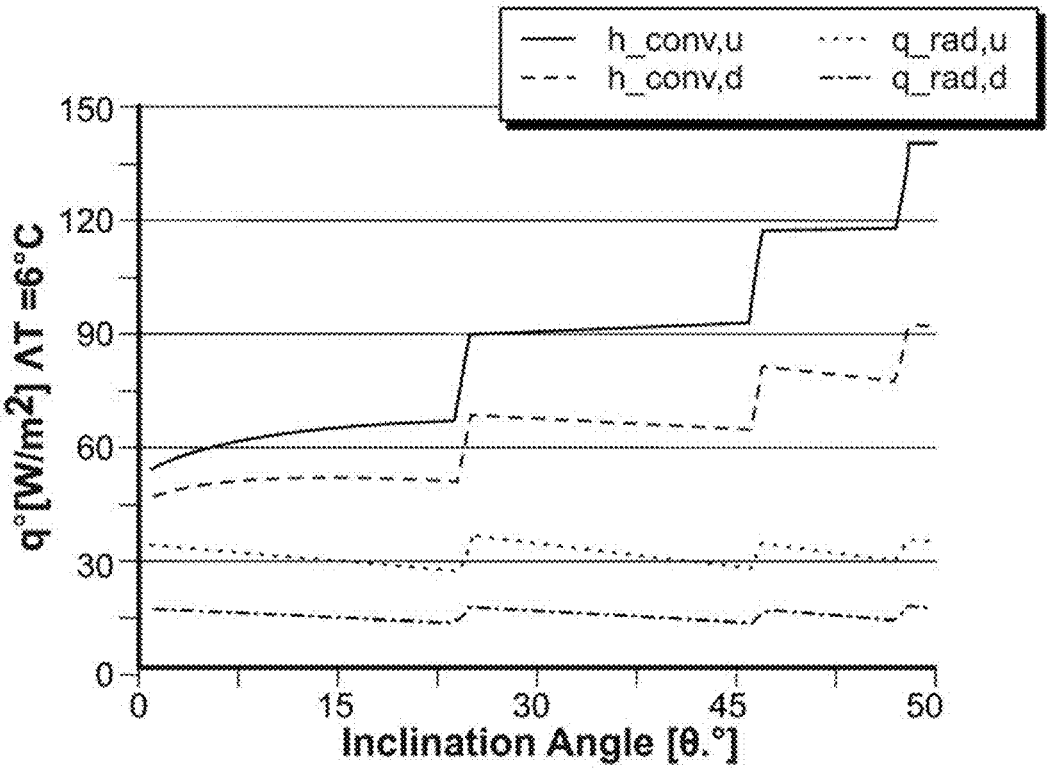
FIG. 6A shows a prediction model for radiant, convective, and total heat transfer shares of total cooling capacity relative to interior fold angle and surface packing of a zigzag-folded VLCS.
Figure 6B:
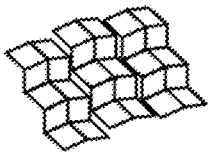
FIG. 6B depicts an inclination fold angle and increased surface area packing for inclination angles of about 15°.
Figure 6C:
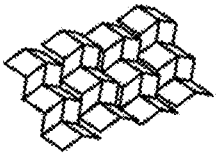
FIG. 6C depicts an inclination fold angle and increased surface area packing for inclination angles of about 45°.
Figure 6D:
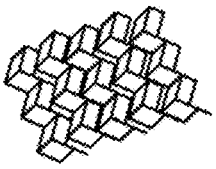
FIG. 6D depicts an inclination fold angle and increased surface area packing for inclination angles of about 60°.

FIG. 6A shows a prediction model for radiant, convective, and total heat transfer shares of total cooling capacity relative to inclination fold angle and surface area packing of a zigzag VLCS according to one embodiment. FIGS. 6B-D includes diagrams depicting inclination fold angles and increased surface area packing for inclination angles of about 15° (FIG. 6B), about 45° (FIG. 6C), and about 60° (FIG. 6D). For a given 1 $m^2$ projection area (generally flat XY-plane), the about 15°, 45°, and 60° inclination angles generally increase the total surface area of the zigzag geometry by about 0%, 33%, and 66%, respectively. FIG. 6A also shows that a VLCS according to the embodiments detailed herein has a generally increased total cooling capacity for radiant cooling, e.g., in a building.

Figure 7:
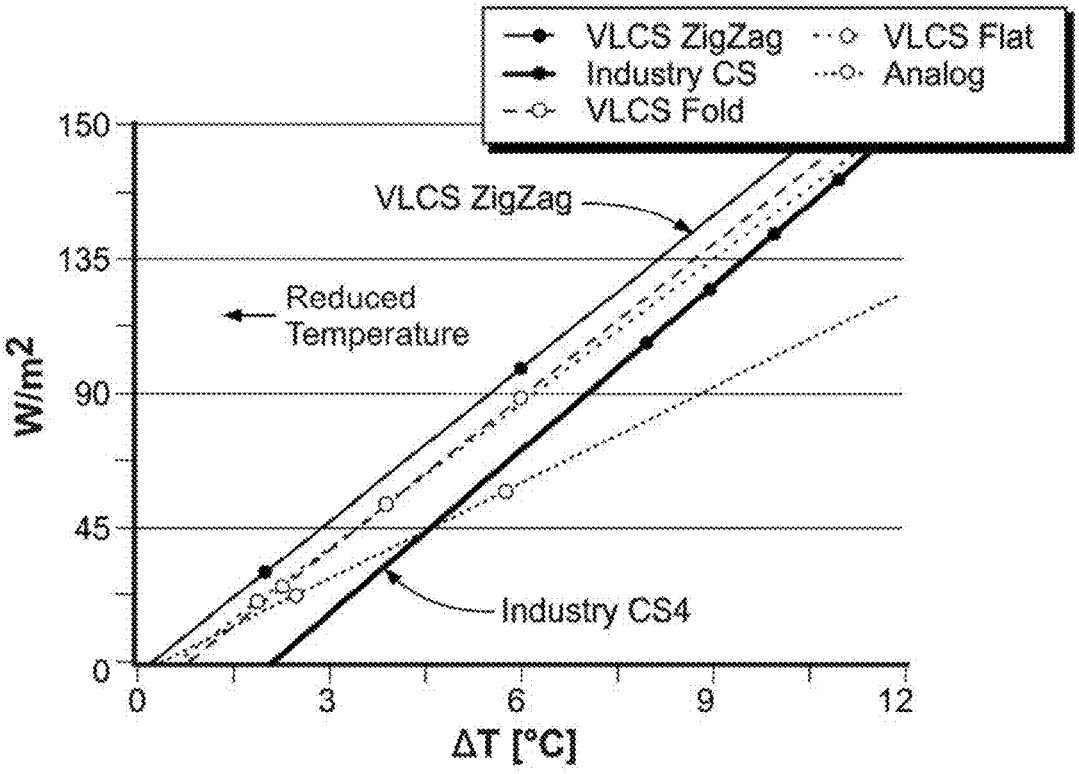
FIG. 7 is a graph showing cooling capacity in relation to room temperature and surface temperature differences for the VLCSs described herein and an industry chilled sail.

FIG. 7 illustrates cooling capacity in relation to room temperature and surface temperature differences for the VLCSs described herein and an industry chilled sail. VLCS Flat, as referenced in FIG. 7, is a laminated structure comprising at least one flexible micro-channel water-circuit layer coupled with at least one structural layer, where the laminated structure has a generally 2D surface geometry.

As shown in FIG. 7, the cooling capacity for all VLCSs in accordance with the embodiments described herein (i.e., VLCS Zigzag, VLCS Fold, and VLCS Flat) demonstrated an increased cooling capacity as compared with the Industry CS and the Analog. Increased total cooling capacity generally results in a reduced temperature-lift requirement for an equivalent radiant cooling load in buildings. The reduced temperature-lift generally reduces the amount of energy required to chill water and increases the coefficient of performance (COP) for the chiller, further reducing the total primary energy demand of the system. An ancillary benefit to reduced temperature-lift includes, e.g., a reduction of surface temperature across the VLCS, which can reduce the occurrence of condensation, potentially increasing the number of natural ventilation hours without the use of mechanically conditioned air under the ASHRAE-55 adaptive comfort model.

Figures 8A, 8B:
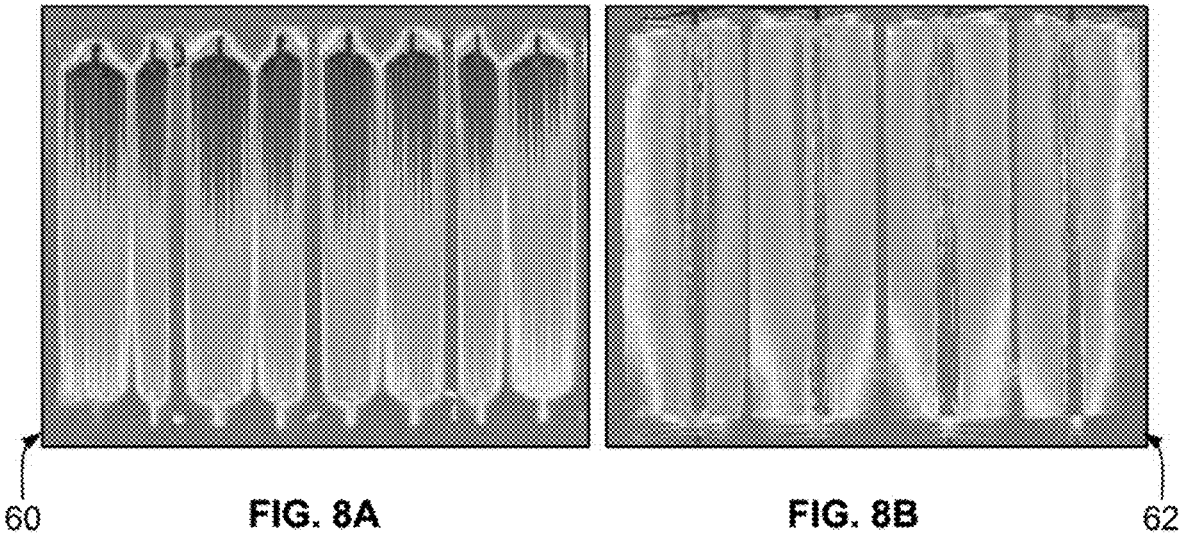
FIG. 8A shows a worm's eye view infrared thermal image showing discrete cooling of a microfluidic water-circuit according to the embodiments described herein.
FIG. 8B shows a worm's eye view infrared thermal image showing discrete cooling of an industry analog with generally parallel piping and solid aluminum fin geometries.

FIG. 8A-8B show a comparison of a PET VLCS device 60 having micro-fluidic water circuits (FIG. 8A) and an industry aluminum chilled sail (CS) 62 with parallel piping and solid aluminum fin geometries (FIG. 8B) using thermal imaging. The distribution of closely packed micro-channel water-circuit of the PET VLCS device 60 increases the thermal conductance of the system, thereby generally reducing the water temperature required to provide equivalent cooled surface temperatures.

The increased thermal conductance of the VLCS devices described herein allows the use of non-standard materials for water-based thermal control. Such non-standard materials include, but are not limited to, polymers, glass, biomaterial, thermoplastic, ceramic, technical ceramics, non-technical ceramics, combinations thereof, and the like.

Figure 9A:
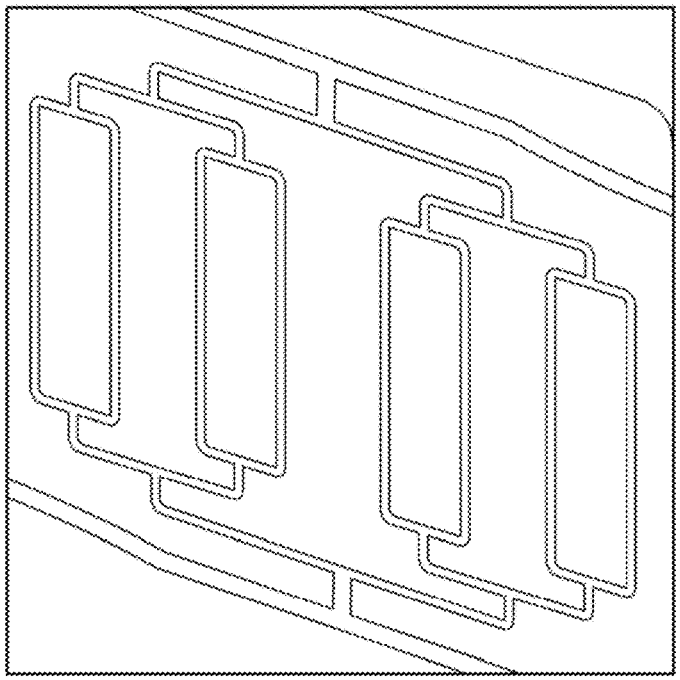
FIG. 9A shows a close-up view of micro-channels of a VLCS according to one embodiment filled with water.
Figure 9B:
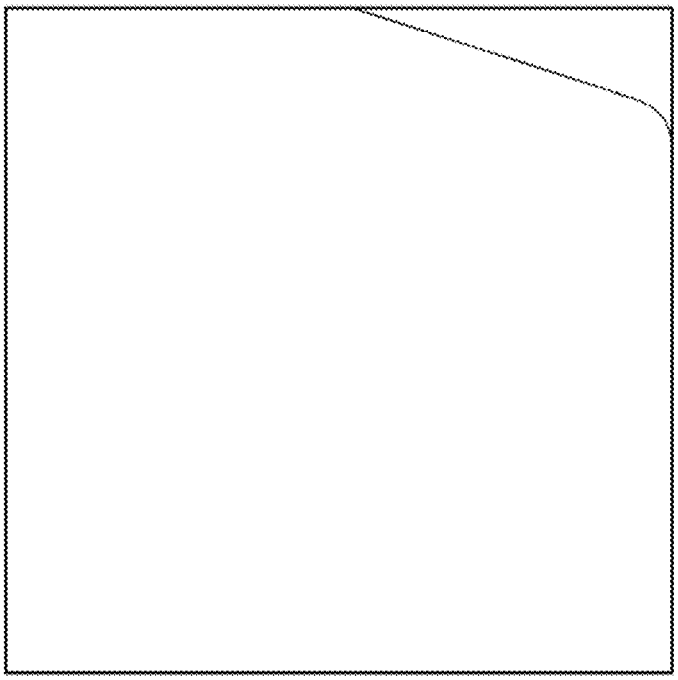
FIG. 9B shows a close-up view of micro-channels of a VLCS according to one embodiment filled with a refractive index-matching fluid.

The heat transfer fluid/medium flowing through the micro-channels may include any suitable fluid including, but not limited to, water, alcohol, oil, any combination thereof, or the like. The heat transfer fluid/medium may include particulates comprised of nanoparticles, microparticles, dyes, pigments, magnetic materials, electrically conducting materials, liquid crystals, any combination thereof, or the like. In some embodiments, the transparency effect of the VLCS devices described herein may be increased or decreased by flowing an index-matched medium through the micro-channel. For example, to generate optically clear devices, the different layers may be disguised to allow transparency to visible light by filling the channel with a medium (e.g., water, ethylene glycol or sugar water) having a refractive index that matches the refractive index of the substrate (e.g., glass or polymer) used to form the micro-channel water-circuit layer(s). For example, FIG. 9A shows micro-channels filled with water, and FIG. 9B shows micro-channels filled with a refractive index matching fluid (about 57% glycerol, about 43% water, n=1.43). As shown, flowing the index matching fluid through the micro-channels results in a substantially or fully transparent device without noticeable channel geometry.

In some embodiments, a thermo-chromic dye is added to water, and the liquid mixture is flowed through the VLCS micro-channel to provide visual feedback about the temperature. For a dimming effect, the micro-channels may also or alternatively be filled with one or more highly absorptive liquids. These properties may dynamically adjust to the lighting conditions. The liquid may be run through a closed-loop system with one or more than one type of liquid flowing in series.

In some embodiments, each laminate layer is cut using any suitable mechanism. In one non-limiting example, a bulk machining process such as computer numerical controlled (CNC) laser cutting, knife cutting, a combination thereof, or the like is utilized.

The flat assembly of the VLCSs described herein allows for roll-to-roll manufacturing of 2D components that may then be formed into 3D shapes with complex surface geometries and integrated liquid-circuits.

The devices and methods described herein may have various applications. It is contemplated that new fabrication and design methods translated from the fields of microelectromechanical systems, microfluidics, and/or meta-materials may offer added energy efficiency and new product applications for water-based thermal regulation. For example, they may enable new approaches to water-based thermal control using a myriad of materials (e.g., polymers) not previously possible with conventional systems. The radiant cooling devices described herein may also play a more predominate role in building design through integration with building products, such as transparent cooling surfaces applied to LED luminaries. The devices may be used as radiant chilled sails and/or radiant chilled partitions for thermal control in building, automotive, airline, and/or other industries. The devices may also be used as multi-service devices with integrated chilled surfaces in architectural luminaries for thermal control in building, automotive, airline, and/or other industries.

The VLCSs described herein may produce a significant building technology shift in the field of water-based thermal control. For example, optically clear (or substantially optically clear) VLCSs may be integrated into architectural luminaries or be directly laminated to organic light emitting diode (OLED) films. This is further supported by the industry's growing use of light-emitting diode (LED) lamps and OLED films, which produce considerably less infrared heat (about 8%) compared to fluorescent (about 70%) and incandescent lamps (about 90%). If the conductive heat of LED lamps is properly managed, this reduction may provide considerable benefits for chilled service products.

For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation." Additionally, the singular terms "a," "an," and "the" include plural referents unless context clearly indicates otherwise.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the invention. It is also contemplated that additional embodiments according to aspects of the present invention may combine any number of features from any of the embodiments described herein.

What we claim is:

1. A radiant cooling device comprising:

a plurality of generally planar panels, each of the plurality of panels including a fluidic layer including one or more micro-channel liquid-circuits, at least one of the one or more micro-channel liquid-circuits having an internal channel configured for fluid flow within the at least one of the one or more micro-channel liquid-circuits, and a structural layer coupled to the fluidic layer, wherein the device further includes a plurality of folds separating each of the plurality of panels such that the device has a three-dimensional surface geometry having a plurality of inclined surfaces, wherein each of the plurality of folds has a generally zigzag shape.

2. The device of claim 1, wherein the fluidic layer is generally flexible.

3. The device of claim 1, wherein the one or more micro-channel liquid-circuits includes a fluid, the fluid including water, alcohol, oil, or any combination thereof.

4. The device of claim 1, wherein each of the plurality of folds is generally linear.

5. The device of claim 1, wherein the plurality of folds extends from a first end of the device to an opposing second end of the device, the plurality of folds including a first set of folds and a second set of folds, each of the folds of the first set of folds being arranged in an alternating manner with each of the second set of folds, each of the folds in the first set of folds being generally coplanar in a first plane, and each of the folds in the second set of folds being generally coplanar in a second plane.

6. The device of claim 1, wherein each of the one or more micro-channel liquid-circuits has a networked channel geometry.

7. The device of claim 1, wherein the structural layer includes a first structural layer and a second structural layer, the fluidic layer being sandwiched between the first structural layer and the second structural layer.

8. The device of claim 1, wherein each of the one or more micro-channel liquid-circuits includes a fluid having particulates therein, the particulates including nanoparticles, microparticles, dyes, pigments, magnetic materials, electrically conducting materials, liquid crystals, or any combination thereof.

9. A method of forming a radiant cooling device, the method comprising:

providing at least one fluidic layer including one or more micro-channel liquid-circuits;

coupling at least one structural layer to the at least one fluidic layer to form a laminated structure;

folding or bending the laminated structure to form a plurality of folds thereon, wherein each of the plurality of folds has a generally zigzag shape, each of the plurality of folds separating the device into a plurality of generally planar panels having a respective plurality of inclined surfaces, the plurality of inclined surfaces forming a three-dimensional surface geometry.

10. The method of claim 9, wherein the fluidic layer is generally flexible.

11. The method of claim 9, further comprising cutting one or more of the fluidic or structural layers using a bulk machining process.

12. The method of claim 9, wherein each of the plurality of folds is generally linear.

13. The method of claim 9, wherein the plurality of folds extends from a first end of the laminated structure to an opposing second end of the laminated structure, the plurality of folds including a first set of folds and a second set of folds, each of the folds of the first set of folds being arranged in an alternating manner with each of the second set of folds, each of the folds in the first set of folds being generally coplanar in a first plane, and each of the folds in the second set of folds being generally coplanar in a second plane.

14. The method of claim 9, wherein each of the one or more micro-channel liquid-circuits has a networked channel geometry.

15. The method of claim 9, wherein the at least one structural layer is at least two structural layers, the fluidic layer being sandwiched between the at least two structural layer.

16. The method of claim 9, wherein the at least one fluidic layer includes a first fluidic layer and a second fluidic layer, the one or more micro-channel liquid-circuits of the first fluidic layer being fluidly coupled to the one or more micro-channel liquid-circuits of the second fluidic layer via one or more through-holes.

17. The method of claim 9, wherein each of the one or more micro-channel liquid-circuits includes a liquid having particulates therein, the particulates including nanoparticles, microparticles, dyes, pigments, magnetic materials, electrically conducting materials, liquid crystals, or any combination thereof.

18. The device of claim 1, wherein the micro-channel liquid-circuits have dimensions ranging from about 1000 nm to about 1000 μm.

19. The device of claim 1, wherein each of the one or more micro-channel liquid-circuits of each of the plurality of panels is generally independent of the one or more micro-channel liquid-circuits of the other of the plurality of panels.

20. The method of claim 9, wherein the micro-channel liquid-circuits have dimensions ranging from about 1000 nm to about 1000 μm.

21. The method of claim 9, wherein each of the plurality of generally planar panels includes at least one of the one or more micro-channel liquid-circuits, the at least one of the one or more micro-channel liquid-circuits of each of the plurality of generally planar panels being generally independent.

* * * * *